United States Patent [19]

Allen, Jr.

[11] Patent Number: 5,034,042

[45] Date of Patent: Jul. 23, 1991

[54] STRUCTURE AND FILTER FOR PAINT SPRAY BOOTH

[75] Inventor: George E. Allen, Jr., Carol Stream, Ill.

[73] Assignee: Binks Manufacturing Company, Franklin Park, Ill.

[21] Appl. No.: 441,167

[22] Filed: Nov. 27, 1989

[51] Int. Cl.[5] ..... B05C 15/00

[52] U.S. Cl. ..... 55/385.2; 55/483; 55/495; 55/DIG. 46; 98/115.2

[58] Field of Search ..... 55/385.2, 483, 491, 55/495, 501, DIG. 46; 98/115.2

[56] References Cited

U.S. PATENT DOCUMENTS

| | | | |
|---|---|---|---|
| 1,520,796 | 12/1924 | Bartling | 98/115.2 |
| 3,388,536 | 6/1968 | Nash | 55/501 |
| 4,133,255 | 1/1979 | Guice | 55/DIG. 29 |
| 4,231,289 | 11/1980 | Domicent | 98/115.2 |
| 4,664,061 | 5/1987 | Morioka et al. | 98/115.2 |
| 4,693,048 | 9/1987 | Guetersloh | 98/115.2 |
| 4,700,615 | 10/1987 | Napadow | 98/115.2 |
| 4,848,215 | 7/1989 | Morioka et al. | 55/DIG. 46 |

*Primary Examiner*—Jay H. Woo
*Assistant Examiner*—C. Scott Bushey
*Attorney, Agent, or Firm*—Juettner Pyle & Lloyd

[57] ABSTRACT

A structure and a filter suitable for a paint spray booth, oven, or a combination booth and oven is described and includes outer walls enclosing the structure, only a portion of which provides the structural support for the booth's walls and roof. The interior of the booth has a plurality of filters on the walls and ceilings for supplying air from essentially the walls and ceiling to provide a more uniform air flow so that the painter is less exposed to vaporizing solvents, and when used as an oven, the heating is more uniform. Each of the filters made of a cloth material held in place by filter frames and may be used with either battens fixed to the frames or removable and held in place in pockets provided in the filter cloth.

19 Claims, 8 Drawing Sheets

STRUCTURE AND FILTER FOR PAINT SPRAY BOOTH

This invention relates to a painting structure, and more particularly to a painting structure having air plenums in substantially all of the structure's walls and ceiling to provide uniform, filtered airflow from the walls and ceiling and surrounds an article being painted or heated in the structure.

BACKGROUND OF THE INVENTION

Heretofore it has been known to make painting structures, such as paint spray booths, ovens or booth/ovens of rectangular or square cross-section or sometimes with a gable in the roof line to accommodate lighting fixtures. Prior art booths of these types can be seen in U.S. Pat. No. 4,220,078 and U.S. Pat. No. 4,222,319. These booths have filtered air emanating from the ceiling of the booth, then flowing into a work space below the ceiling, and thereafter, being drawn out from the bottom of the booth through a downdraft opening in the floor of the booth. While the air flow around the article being worked on, such as for example an automotive vehicle being painted, is excellent, the air flow provided to the workman may not always be ideal when the workman is, say, spraying the lower portion of the vehicle after having sprayed adjacent higher portions. The less than ideal air flow results as the solvents vaporizing off the higher painted portions may be carried to or close to the painter. Additionally, if this type of ceiling air flow is provided in an oven or a spray booth-/oven, the temperature of the article may not be uniform as the upper portion of the article is closer to the source of the heat. Hence, the rate of paint solvent vaporization and drying may not be uniform over various portions of the article, and that can cause paint defects.

In another type booth shown in U.S. Pat. No. 4,133,255, the filtered air is similarly supplied from the ceiling of the booth, but is withdrawn from the work space beneath the ceiling by exhaust ducts set in the lower ends of the side walls of the booth, instead of through an opening in the center of the booth's floor. This construction is disadvantageous as it pulls the solvent ladden air to the side where the painter may be standing, and particularly when the painter is working down low on the vehicle. Further, if this type painting structure was also a hot air type booth/oven with heated air being supplied from the ceiling, the temperature of the painted article and, consequently, the paint solvent vaporization and paint drying rates would vary depending upon the distance from the ceiling.

U.S. Pat. No. 4,664,061 (FIG. 15) shows an automated spray booth with filtered air emanating from the ceiling and the lower portions of the booth's side walls. However, no air is discharged through the upper portions of the side walls. Thus, there are still some portions (where if a painter were present, the painter's head may spend considerable time), the upper outer portions of the booth, that are not purged as fully as other portions thereof. Further, while there may be air flow throughout the booth and around the article being painted, it is not uniform at all locations. Thus, if this type booth were used as hot air oven or booth/oven for drying paint, the temperature of the article in the oven, the painted surfaces and the rates of vaporization of solvents from the paint and of drying of the paint may not be as uniform as desired.

BRIEF SUMMARY OF THE PRESENT INVENTION

The painting structure of the present invention overcomes the foregoing disadvantages by providing a painting structure comprising a pair of spaced outside walls provided by a plurality of heavy wall structural portions and a plurality of alternately spaced adjacent lighter wall plenum portions, joined by a roof of a similar construction having heavy wall structural portions and lighter wall plenum portions, a floor, inner filter wall portions closing off the wall plenums and a filter ceiling portions closing off roof or ceiling plenums, the structure's work space being formed between the heavy wall structural portions, the inner filter walls, filter ceiling and floor. The heavy structural portions carry the roof. The roof air plenum area is connected to side wall plenums located between the outer walls and the inner filter walls. Thus, the booth of the present invention has air supply plenums which nearly surround the work space of the booth.

Preferably, the two wall plenums on opposite sides of the booth are joined to the adjacent roof or ceiling plenum to form a large inverted "U" shaped air distribution duct system. A plurality of these "U" shaped ducts are formed along the length of the booth, with intervening spaces between the adjacent ducts taken up and closed off by the heavy wall structural portions of the outer walls and roof which support the booth and carry its lighting fixtures. Each inverted "U" shaped duct is connected to the adjacent inverted "U" shaped ducts at their upper corners by the spaces between the outer exterior of the booth and a gabled cornered of the inner filter wall, filter ceiling and heavy structural wall portions. This construction provides the advantage of flexibility in permitting locating the necessary air treatment conditioning and/or heating equipment almost anywhere around the perimeter of the booth where space permits. The equipment can then be connected to the closest adjacent portion of the gable ducts or wall or ceiling plenums, and with appropriate baffling provides essentially uniform air flow from all portions of the filter inner walls and filter ceiling. As the inner filter walls and filter ceiling extend for essentially the full length of the booth, except for provisions for the supporting heavy structural portions of outer walls, roof and light fixtures, the flow of air from the surrounding air distribution plenums into the work space is generally uniform. When the above construction is coupled with a center draw downdraft opening for withdrawing air from the structure, the air flow in the booth is such that a painter working therein is not normally subject to air which is carrying evaporating solvent vapors. Thus, the painter enjoys clean, filtered air essentially at all times, even when working down low, say on a vehicle's rocker panel.

Further, the booth is constructed in such a manner that only portions of the booth's outer walls and roof need be sturdily built, actual support the booth, and eliminate the need for special framing. At the same time these outer walls are bent and formed to enclose portions of the adjacent air plenums. The same material saving construction is used for the roof.

Both the inner filter walls and filter ceiling include removable filter frame means for carrying the filter cloth material and to hold the same in place in a manner that also permits easy changing of the filter cloth. To this end portions of the filter frame means are pivoted at one end and latched at the other so that that portion of the ceiling filter frame means and filter cloth can be lowered to be changed. The filter cloth itself is, preferably, made in one piece covering one half the booth, and extends over one half the ceiling, one of the gables and one of the side walls, and is supported on battens permanently secured to the filter frame means. Optionally, the battens, instead of being permanently secured to the filter frame means, are removably secured to the filter frame means and carried by the filter cloth itself, preferably, in pockets formed or sewn into the filter cloth. The filter frame means themselves are secured to the outer walls and/or roof or other portions of the booth.

Additionally, the painting structure of the present invention comprises an adjustable floor which is made up of a plurality of removable floor panels held or supported above the ground by a plurality of inclined bar joists which, in turn, are secured to floor feet secured to or engaged with the ground. One or more of the floor panels, inclined bar joists and floor feet may be provided with adjustment means in the form of slotted openings and held together by fastener means in the slotted openings so that one or more of these members can be adjusted to provide a level floor on uneven ground. Preferably, this slotted opening is provided in the floor feet for the bar joists.

It is a primary object of the painting structure of the present invention to provide air flow from a substantial portion of the structure's walls and ceiling.

Another object of the painting structure of the present invention is to normally provide fresh air flow at essentially all times to a painter working in the structure.

Another object of the painting structure of the present invention is to provide more uniform flow of heated air to all portions of a freshly painted article on which paint is being baked or dried in the structure.

A still further object of the painting structure of the present invention is to provide a filter wall and filter ceiling comprising a filter cloth which can be supported by fixed or removable battens and easily changed.

Yet another object of the painting structure of the present invention is to provide a plurality of narrow, heavy wall structural portions in the walls and roof which carries the weight of the structure, provides it structural support, carries its lighting fixtures, and provides portions of its air plenums.

Still yet another object of the present invention is to provide a floor structure for a booth which can be easily made level on uneven ground.

These and other object of the present invention will become apparent from the following written description and accompanying drawings.

DESCRIPTION OF THE PREFERRED EMBODIMENT

Figure 1:
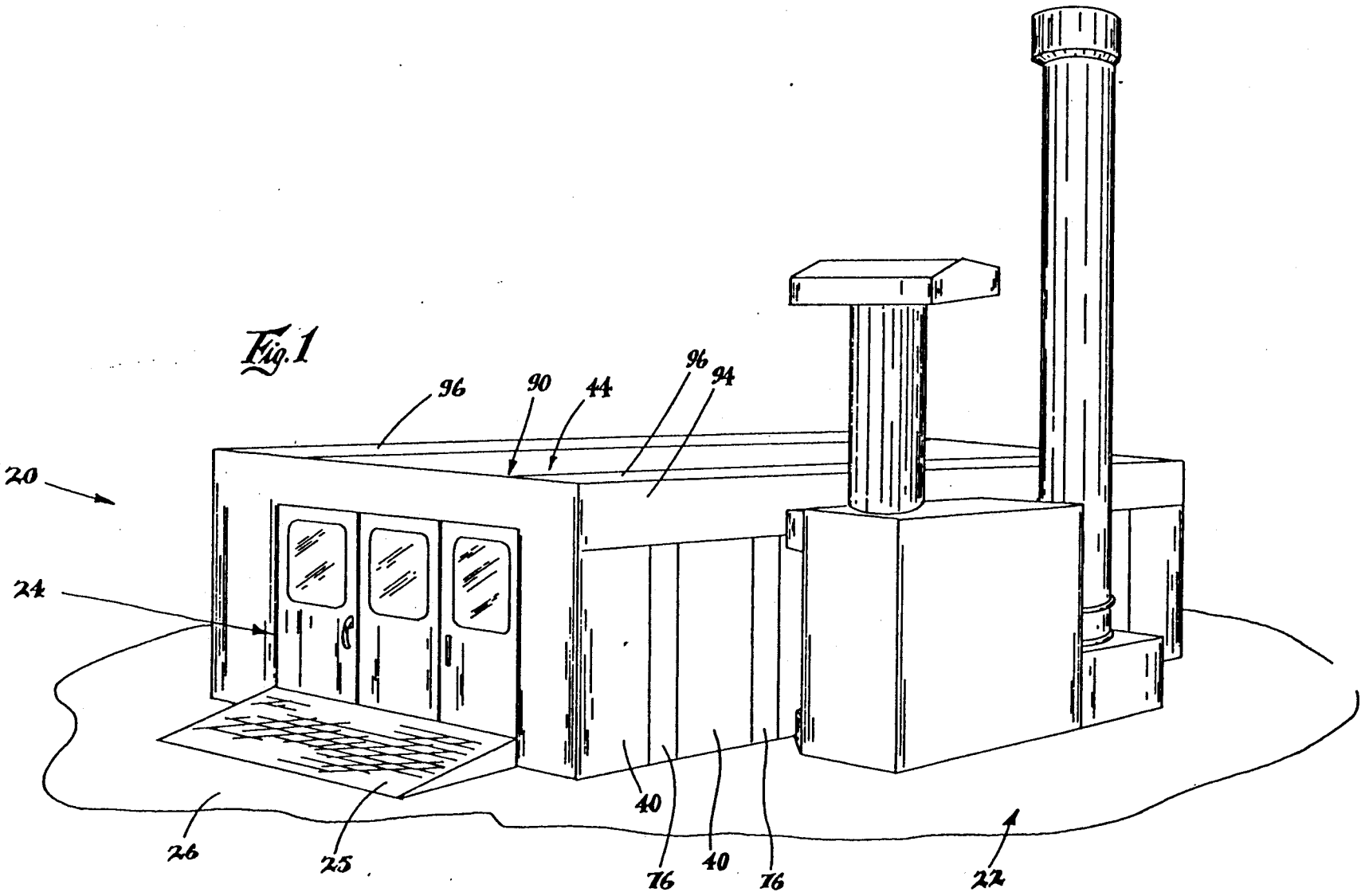
FIG. 1 is a perspective view of the painting structure of the present invention which can be used, in this instance, as a spray paint booth and paint baking oven.

Referring to FIG. 1, a perspective view of the structure or booth 20 of the present invention is shown and can be used either as a paint spray booth or a paint drying or baking oven. The booth 20 generally comprises an enclosing structure of the present invention and is of the downdraft type, having air conditioning and heating equipment 22 located on its periphery for supplying clean, and at times, heated air to the booth and receiving exhausted air back from the booth. By way of example, the booth of the present invention will be described as of the type used to paint automobiles in a body shop, and has a three panel door 24 at one end, one door panel opening separately for personnel and the other two door panels being of an intermediately hinged bifold construction, and when opened in conjunction with the first panel, permitting entrance and departure of a vehicle to be painted. To facilitate entry and exit, a ramp 25 is provided on the ground 26. Of course, the invention could be utilized on other types of booths, such as an elongated tunnel type production booth, or on other size booths for painting larger or smaller articles. Further, the ramp could be omitted, if the booth was positioned in the ground so the bottoms of the doors 24 were level with the ground. As can be seen, the side wall of the booth is made from various pieces of sheetmetal as will become apparent from the following description.

Figure 2:
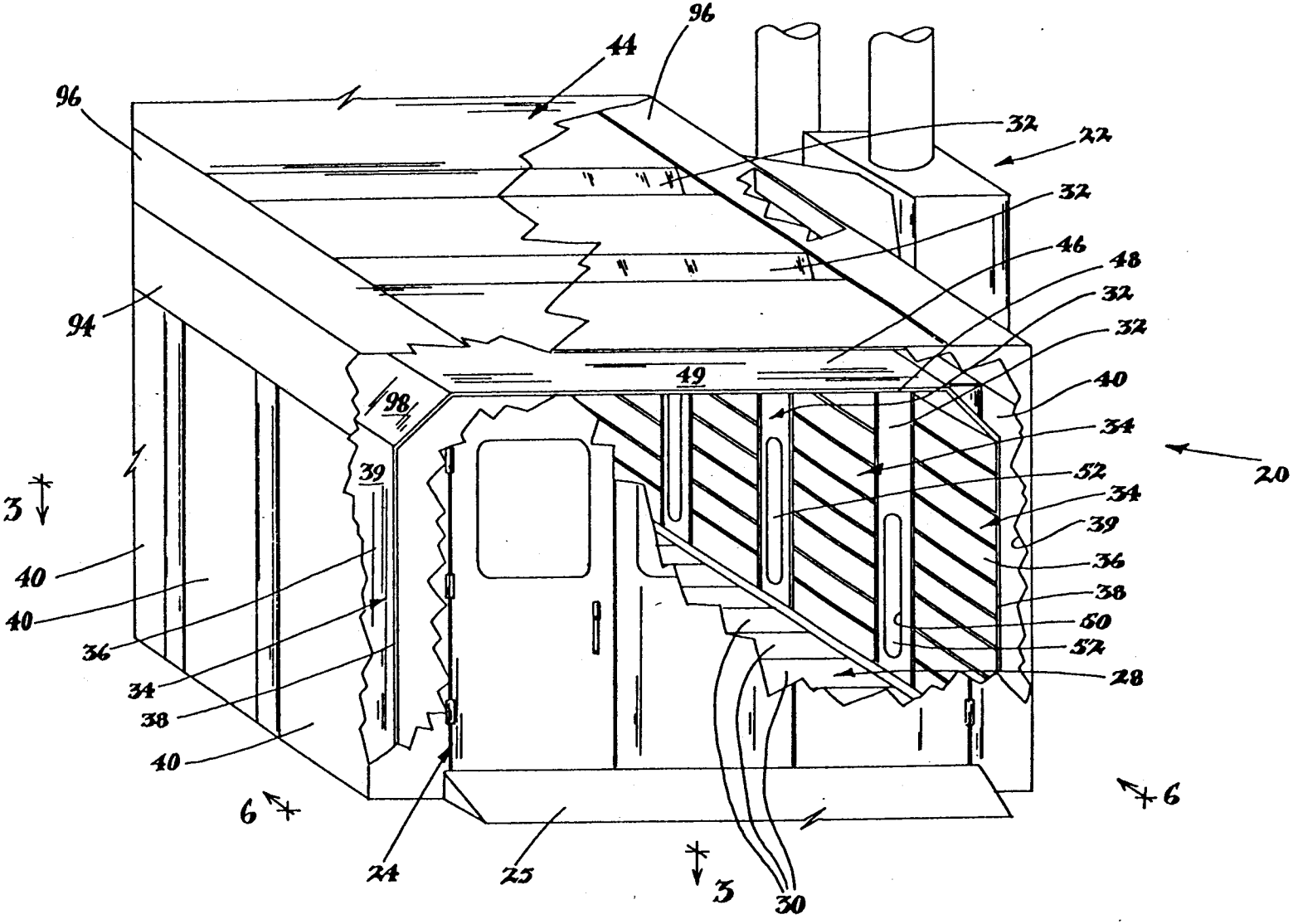
FIG. 2 is an enlarged perspective view of a portion of the booth shown in FIG. 1 with portions thereof broken away to better illustrate features of the invention.

Referring to FIG. 2, portions of the booth of FIG. 1 are broken away to show the interior of the booth. As can be seen, the interior has a floor 28 made up of a plurality of floor panels 30 supported above the ground, as will be more fully described later. The side walls which comprise heavy weight structural portions 32 which carry the weight of the roof, filter walls 34 which are made of filter cloth 36 held in place by filter frame means 38. Behind the filter walls 34 are wall air plenums 39 of the air distribution duct system, which plenums are closed off to the outside by lighter weight panels 40. The roof 44 of the booth is similarly constructed, the heavier weight structural portions 32 carrying up over the roof to the other side to join similar portions of the other side wall. Again, the roof is provided with a filter cloth ceiling 46 on the inside of the booth, which cloth is again held in place by filter frames 48. A roof air plenum 49 is formed between the roof and ceiling filter cloth and is connected to the side wall plenums 39 at either side. As is shown, the structural portions 32, both on the side wall and ceiling are provided with openings 50 covered by glass 52, and lighting fixtures 54 (FIG. 3) are positioned outside and behind of the windows 50 and can shine therethrough to illuminate the booth.

Figure 3:
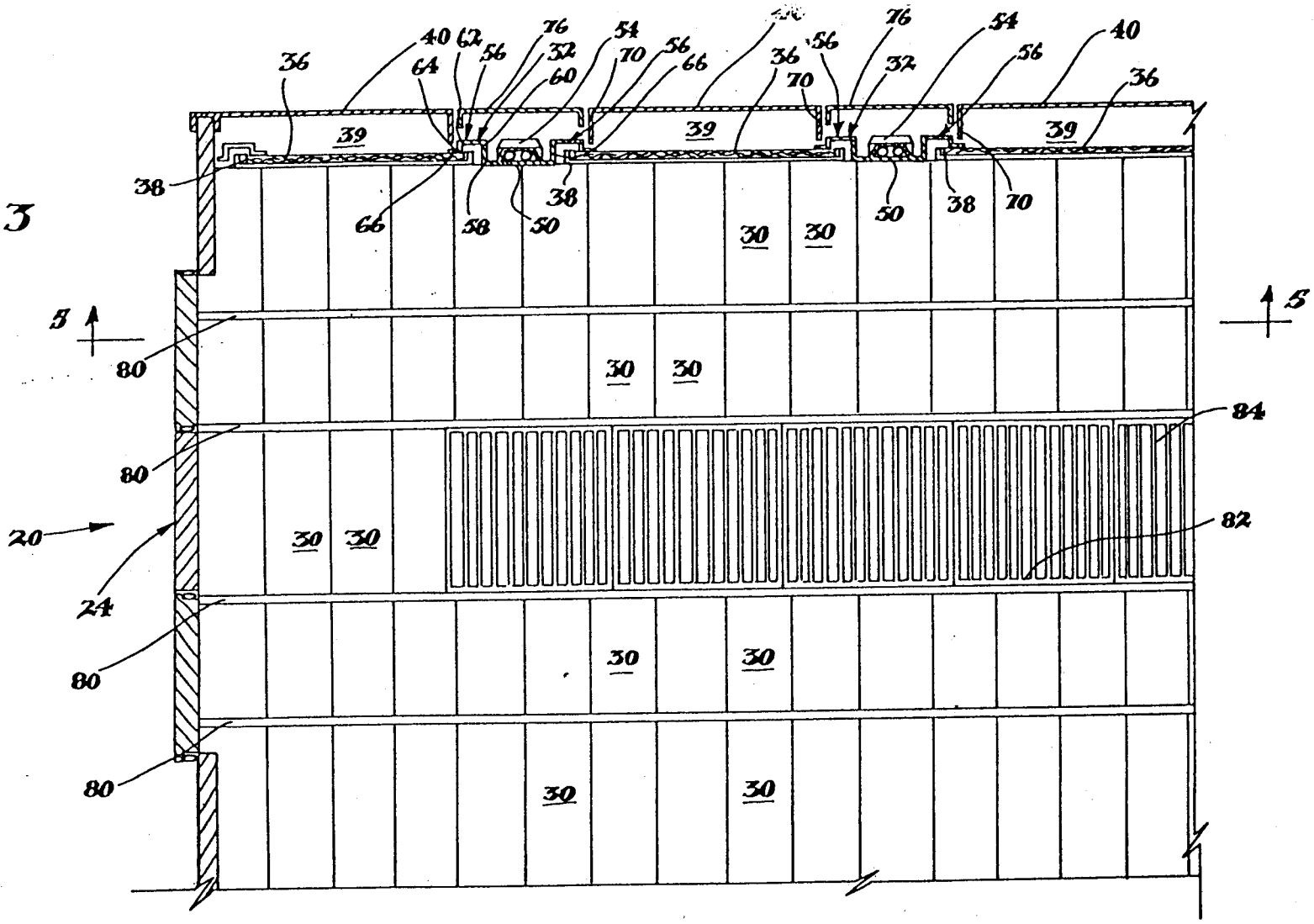
FIG. 3 is a further enlarged cross-sectional plan view taken along the lines 3—3 of FIG. 2.

Referring the FIGS. 3 and 4, the construction of the booth will be described in more detail. As can be seen, the structural portions 32 are bent to a shape to provide a central flat panel to carry the window. While the window opening 50 is relatively large, it does not substantially weaken the panel as most of the strength comes from the adjacent bent sides 56. These bent sides have a first bend 58 at 90° to the outside, a second bend 60 at 90° back parallel to the side wall, a third bend 62 at 90° toward the inside, a fourth bend 64 at 90° back parallel to the side wall, and a short extending parallel portions 66. The other side of the structural portion 32 being similarly and symmetrically bent. These four bends 58, 60, 62 and 64 form a first inwardly opening pocket which will cooperate with the filter cloth 36 and filter cloth frame 39 to hold and seal the filter cloth to the side of the plenum 39. A similar construction is provided at the end of the booth for the other side of the filter cloth and filter frame. As can be seen in FIG. 3, this construction is repeated for the length of the booth.

To close off the individual side wall air plenums formed between adjacent structural portions 32, lighter gauge outside panels 40 are provided. In this instance, the structural portions 32 are formed of 16 gauge steel sheetmetal, and the lighter panels 40 are formed of 18 gauge steel sheetmetal. The panels 40 are also bent perpendicularly at their ends and the flanges 70 so formed are secured to the adjacent structural portions 32 by conventional means such as fasteners (not shown). As is shown, for appearance sake and to protect and keep the light fixtures 54 clean, the space behind the structural portions 32 and between panels 40 is closed off by snap fit in panels 76, which can be easily removed to service the light fixtures 54. The construction of the roof is similar to that of the above described wall and will be further described in conjunction with FIG. 5.

As can be seen in FIG. 3, the floor 28 comprises a plurality of floor panels 30 set on channels 80. The center of the floor has a large opening 82 therein, typical of downdraft type paint spray booths, covered with grills 84. The floor construction will be further described in conjunction with FIG. 5.

Figure 6:
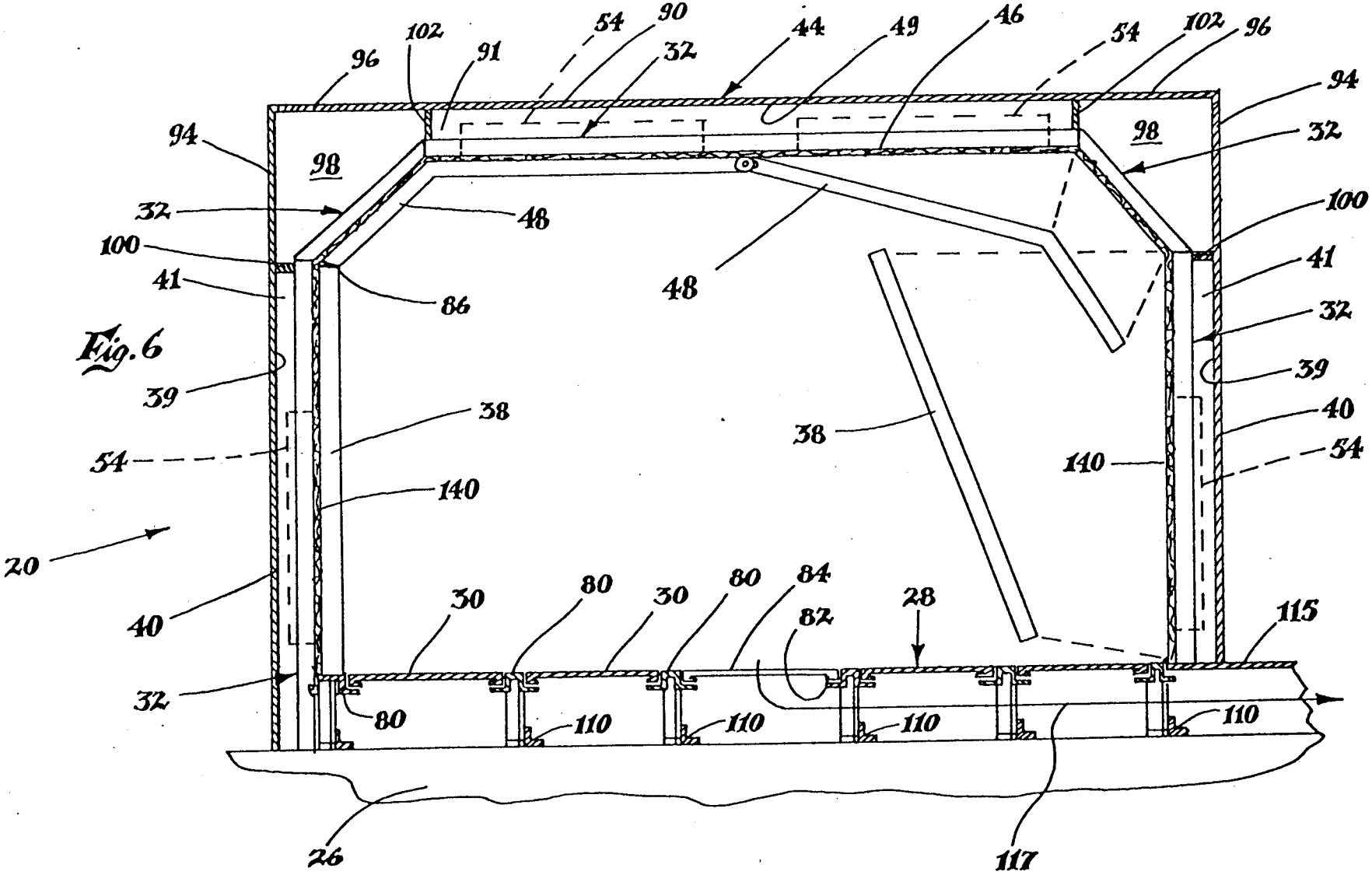
FIG. 6 is a schematic cross-sectional view of the structure of FIG. 1 taken along the lines 6—6 of FIG. 2 showing the construction of the structure and the filter frames for the ceiling and side walls, and indicating how they may be removed.

Referring to FIG. 6, the manner in which the structural portions 32 carry over the roof from one side to the other side is shown. The structural portions 32 at the upper corners are bent 45° inward to form gables on the interior of the booth. The lower end of support portion 32 may be formed as a separate part and then secured as by fastening or welding as indicated at 86. The horizontal or roof section of portion 32 is again bent at a second 45° to the gable segment and at 90° to the side wall segment. However, this time the joint is preferably welded together. As is shown to enclose the plenums 49 and 39 in the ceiling and side walls, the side ends of the plenums are closed at the side walls by the bent flanges 41 of the panels 40, the bent flanges 91 of the ceiling panels 90 which are similar to panels 40. The upper corners for the length of the booth are covered by sheetmetal panels indicated at 94 and 96, and are over the gables so that a gable connecting duct 98 is formed in each corner to interconnect the individual inverted "U" shaped ducts and the ceiling and side wall plenums. To keep air from flowing into the recesses formed for the light fixtures 54 on both the side walls and roof, the gable ducts 98 are closed off by horizontal end panels 100 which fit into and seal with the structural portion 32 for the side wall, and by vertical end panels 102 which fit into and seal with the structural portion 32 for the roof.

Figure 5:
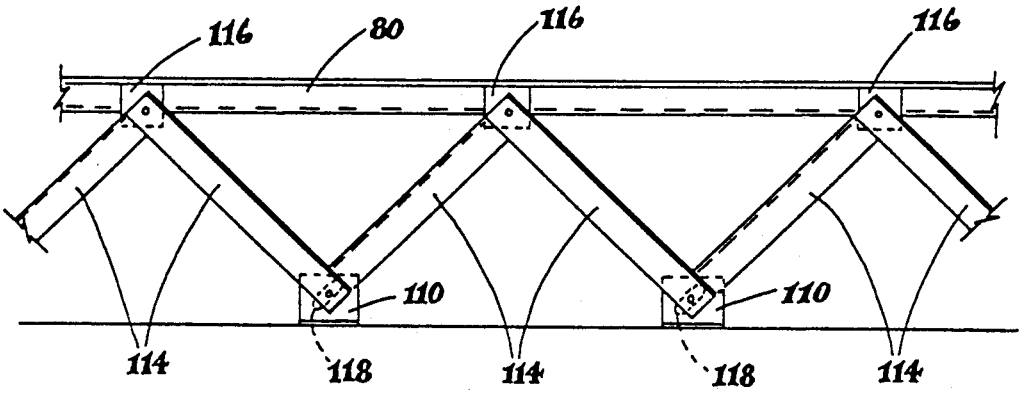
FIG. 5 is a yet further enlarged view taken along the lines 5—5 of FIG. 3.

As is shown in FIGS. 3, 5 and 6, the floor of the booth is supported above the ground by small angle feet pieces 110 some of which may be secured to the ground and others merely resting on the ground. These small floor feet or angles 110, in turn, carry angular joist bars 114 which are secured at roughly 45° angles. The upper ends of the joist bars 114 are, in turn, secured to mounting tabs 116 for the floor channels 80. The mounting tabs are, in turn, welded to the channels 80. The channels 80 (FIG. 6) are somewhat hat shaped in cross-section, having a center portion shaped like the top of the hat and its sides, and a brim or extending side flanges upon which the individual floor panels 30 sit. To provide a level floor in the booth when the ground (say of poured concrete) upon which it may rest is uneven, an adjusting means 118 is provided in one of the mounting tabs 116, bar joists 114, or floor feet 10. Preferably, the adjusting means 118 is provided in the floor feet 110, and comprises elongated slots set at a 45° angle. Thus, when the floor is assembled, the lower ends of the bar joists are positioned on the floor feet to compensate for any unevenness, and then fastened together with fasteners, such as nuts and bolts. Of course, if desired, when the floor is finally leveled these joints could also be welded. The upper ends of the bar joists 114 are similarly fastened with bolts though through round holes in both the mounting tabs 116 and joists. The floor plates 30 can then be inserted between two adjacent hat shaped sectioned floor channels 80 to form the level floor, even if the underlying ground is uneven. The areas of the floor adjacent the return duct in the floor could, of course, be sealed off with sheetmetal 115 (left side of FIG. 6) and/or the concrete of a pit (not shown) so as to provide a clean return air flow path (as indicated by the arrow 117) beneath the booth floor 28 back to air conditioning and/or heating equipment 22.

Figure 4:
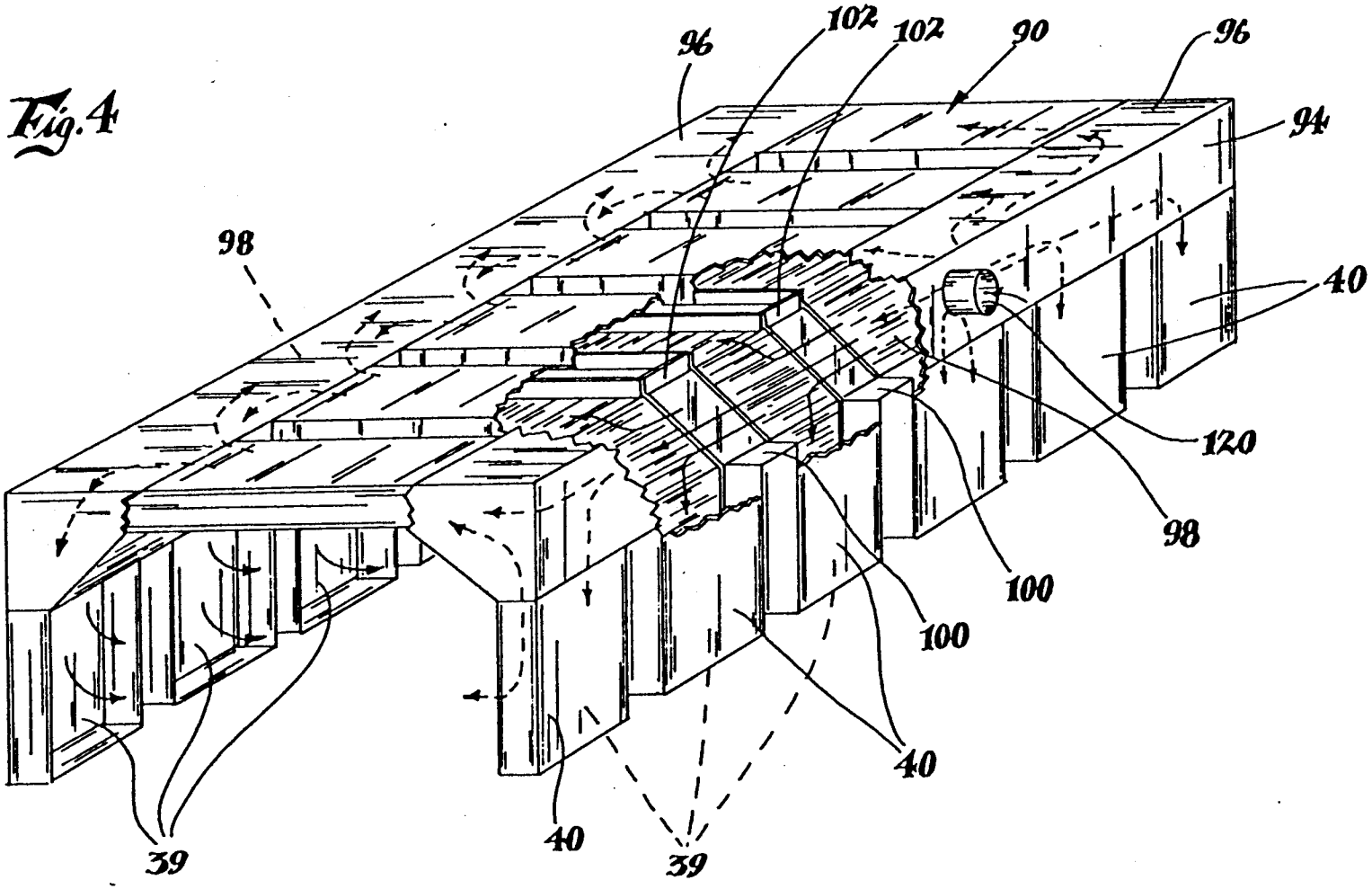
FIG. 4 is a schematic perspective view of the air distribution duct system for the structure of FIG. 1.

As is shown in FIG. 4 from the structure already described, conditioned and/or heated air flow into the supply duct 120 (which can be located anywhere along either side, or at the rear if there is no door there) for the booth and into one of the gable ducts 98 of the air distribution systems of the booth. The ducts and plenums can then be baffled using fenestrated or solid baffles and deflectors to provide nearly uniform flow throughout the ceiling and side walls. From there as indicated by the arrows shown in dotted lines air can flow into either side of the gable duct 98; along the length of the duct 98 to the successive side wall plenums 39 and roof or ceiling plenums 49, across the ceiling plenums 49 to the gable duct 98 on the opposite side, along that gable duct 98 to the successive side wall plenums 39, and out from the side wall and ceiling plenums through the work space, into the grilled opening 82, under the floor 28, and then return to the air conditioning/heating equipment 22. From the foregoing, generally the air distribution duct system should be understood.

Now, the manner in which the air is filtered as it flows from the ceiling and side wall plenums 49 and 39 will be described. Referring to FIGS. 6, 7, 8 and 9, generally one-half side of the booth, including one half the ceiling, the gable and the vertical length of the side wall are covered by a plurality of elongated strips 140 forming the filter cloths 36 and 46 described above. These strips 140 may be made of synthetic fibers and made by Freudenberg Nonwovens Limited Partnership of Chelmsford, Massachusetts and sold under the brand-name Viledon. When installed, each of the filter cloth strips 140 will take on the shape shown in FIG. 9. To hold each of the filter cloths 140 in position, a plurality of filter frame means (38 and 48) are provided to support the cloth strip 140 in position and to seal the perimeter or edges of the cloth strip 140 to adjacent booth structure. The filter frame means (38 and 48) is provided in front of each of the plurality of side wall and ceiling plenums. To facilitate handling and replacement of the filter cloth strip 140, the filter frame means (38 and 40) is, preferably, made in two parts, a ceiling-gable part 150 and a side wall part 152.

Figures 7, 8, 9:
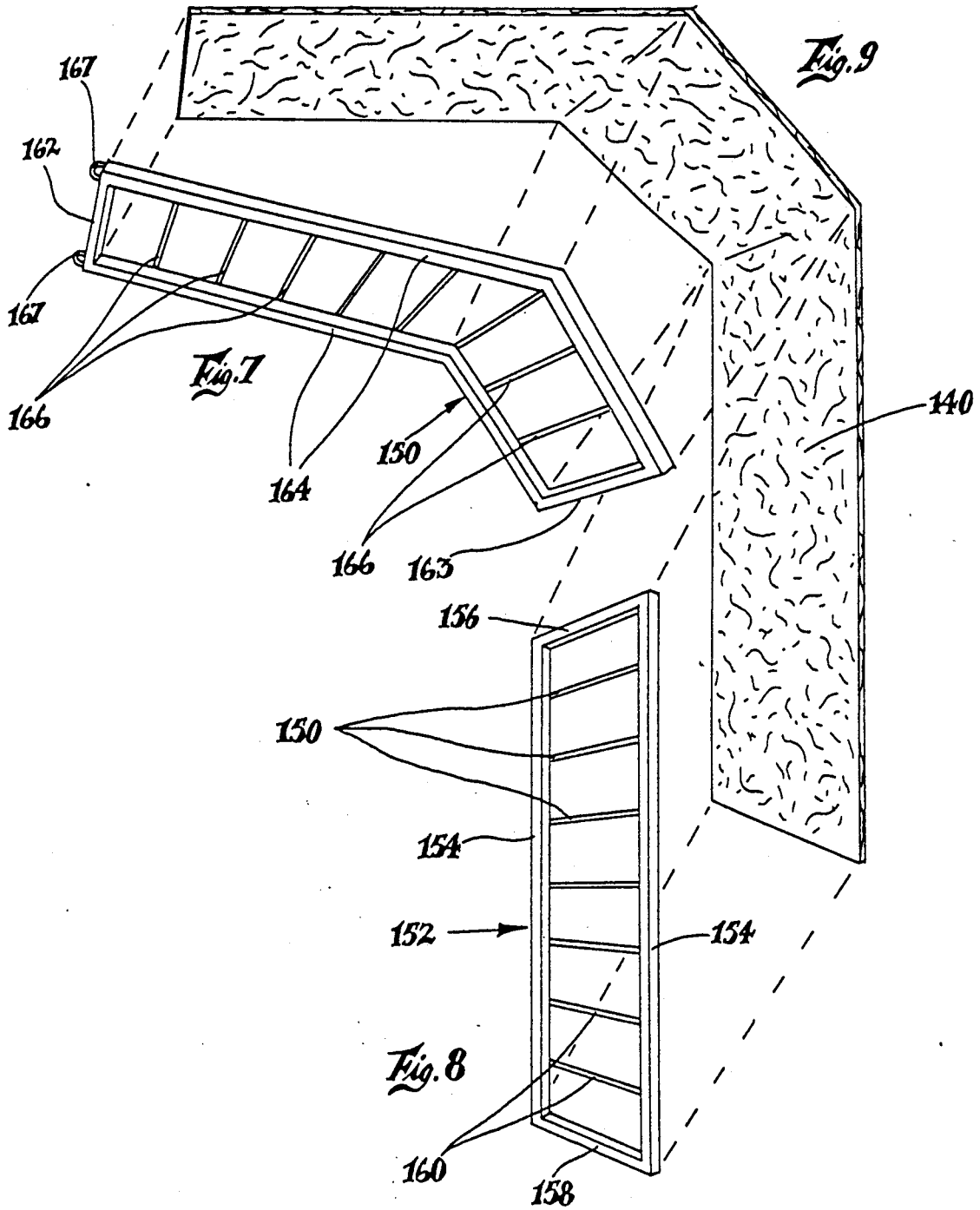
FIG. 7 is a perspective view of the ceiling-gable filter frame shown in FIG. 6.
FIG. 8 is a perspective view of the side wall filter frame shown in FIG. 6.
FIG. 9 is a perspective view of the ceiling-gable and side wall filter cloth shown in FIG. 6.

As is shown in FIG. 8, the lower side wall part 152 of the filter frame means is 41 inches wide, several inches wider than the side wall plenum 39 so as to provide a seal area on its perimeter, and extend from the floor to the bottom of the gable. The side wall part 152 comprises a framework made of say angle, or square or rectangular tubing having two spaced apart side pieces 154, joined to a top piece 156 and a bottom piece 158. To hold the filter cloth strip 140 in place against the air flow, a plurality of battens made of smaller rod or tubing 160 are secured as by fastening or welding to the side pieces 154. As is illustrated in FIG. 6, this lower filter frame means is removed simply by pulling it (as shown it the right side of FIG. 6) from its install vertical position (left side of FIG. 6), wherein it is abutting and forcing the filter cloth against the edges of the sheetmetal forming the side plenum. The side wall filter frame 152 is retained in its installed position by any conventional manner, such as a tight fit with other sheetmetal portions of the booth, such as the perimeter of the side wall plenum opening. Of course, similar lower side wall filter frames are provided for each of the side wall plenum openings.

To complement the lower side wall filter frames 152, the ceiling-gable portion 150 is provided and is similarly constructed as shown in FIG. 7, having a pair side frames 164, a center end 163 and an outer end 165, and by battens 166. However, instead of being merely straight, the side frames 164 are bent to follow both the ceiling and gable. The center ends 163 of the filter frames 150, for convenience, are pivotably secured (as on the rings 167) to the booth structure to permit the ceiling-gable frames to be pivoted down, to give access for changing the filter cloth strips 140 (as is shown in the right side of FIG. 6). The far or gable end of the filter frame 150 is held in place by a conventional means or by being "wedged" in place by the lower (side wall) frame part 152. Also to assist in installing the filter cloth 140, the center end 163 may be provided with fastening means to hold the top edge of the filter cloth in place until the frames can be put in position. Such fastening means may be short spikes or adhesives or velcro, etc. (not shown).

Figures 10, 11, 12, 13, 14:
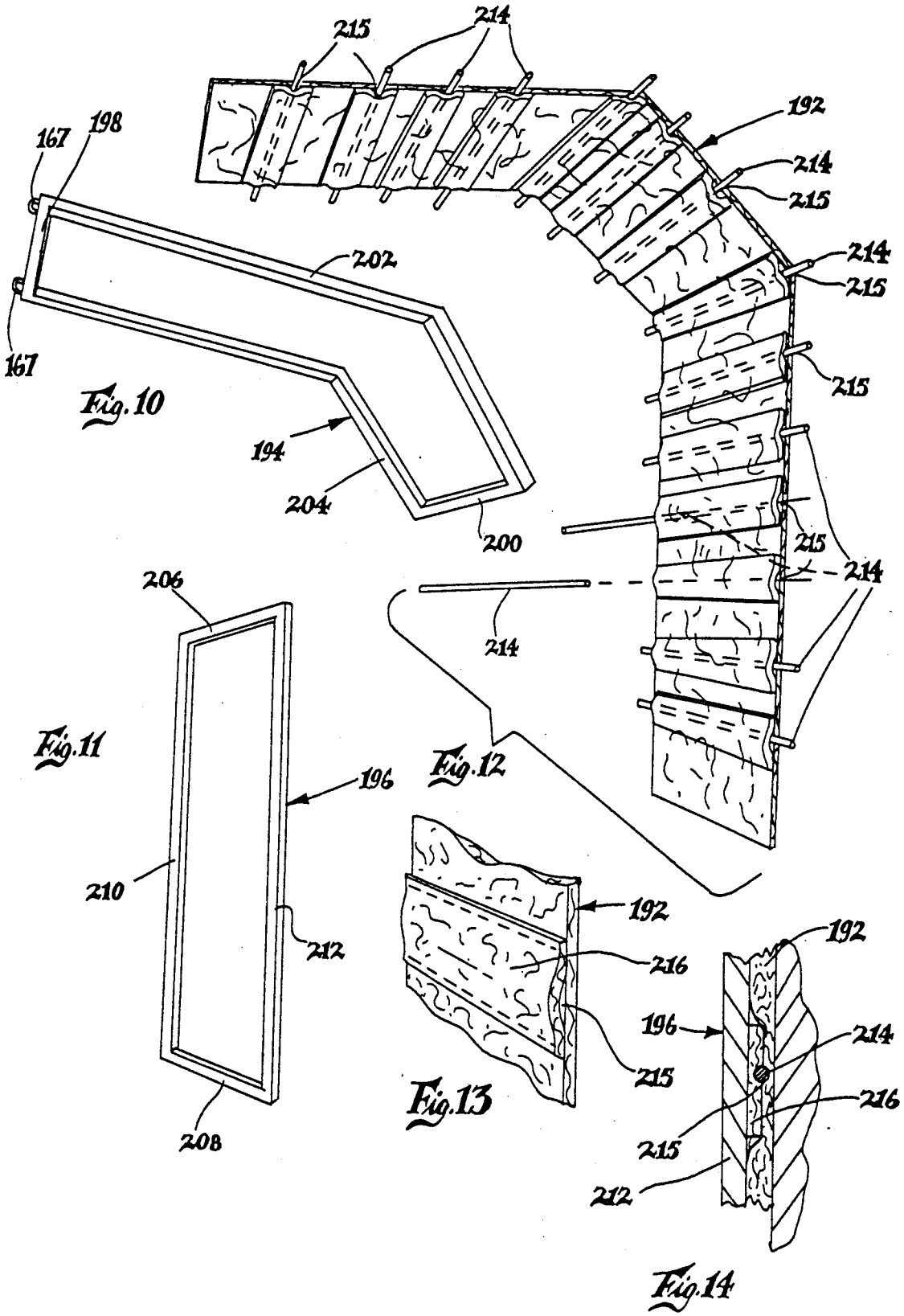
FIG. 10 is an alternative construction for the ceiling gable filter frame.
FIG. 11 is an alternative construction for the side wall filter frame.
FIG. 12 is an alternative construction of the filter cloth for use with the filter frames of FIGS. 10 and 11 and has removable battens held in place in pockets formed on or in the filter cloth.
FIG. 13 is a further enlarged perspective view of a portion of the filter cloth shown in FIG. 12, and one of its sewn in pockets.
FIG. 14 is an enlarged cross sectional view illustrating the manner of supporting the filter cloth with the batten in the sewn in pocket and how the filter frame seals the filter cloth to the booth's structure.

An alternative form of filter frame means and accompanying filter cloth strip 192 is shown in FIGS. 10–13. The filter frame means is generally similar to that previously described, having a pivotable ceiling-gable frame 194 and a side wall frame 196, both made up of four members: ends 198 and 200 and sides 202 and 204 forming the ceiling-gable frame 194, and ends 206 and 208 and sides 210 and 212 forming the side wall frame 196. The principle differences is that there are no battens on the frames 194 and 196. Instead, as shown in FIG. 12, the battens 214 are loose and are held in place by mounting means on the filter cloth 192 itself. As shown in FIGS. 12 and 14, the battens are slipped into pockets 215 sewn into the cloth such as by sewing a separate piece 216 of filter cloth onto the main strip 192, the separate piece 216 being sewn above and below the location of the batten to the main cloth 192. As shown in FIG. 14, when the filter cloth 192 with its pocket 215 provided by the piece 216 and a batten 214 are compressed between the side 212 of the filter frame 196 and other portions of the booth, the filter cloth seals to the booth's sheetmetal and holds the batten 214 in place. Thus, in this version the battens 214 support the filter cloth strips 192, and the filter cloth strips 192 support and hold the battens 214 in position for the length of each of the filter cloth strips 192, from the center of the booth ceiling, over the gable and down the one side wall.

Figure 15:
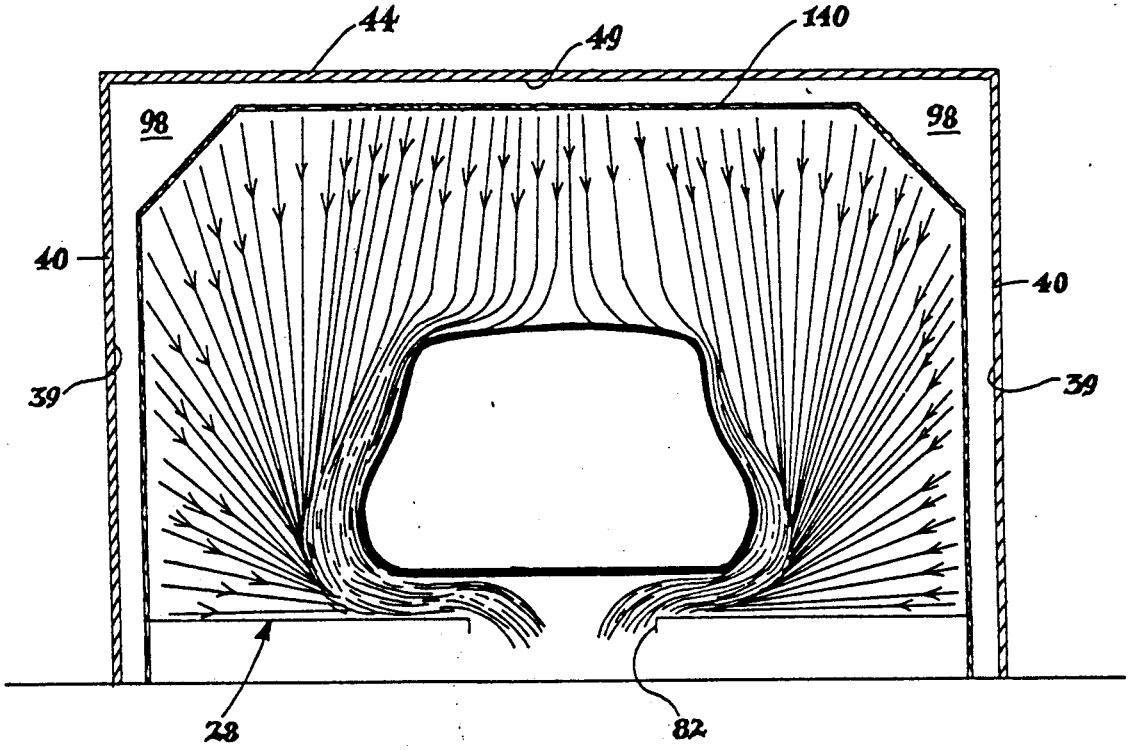
FIG. 15 is a schematic cross-sectional view illustrating how the air flows from the sides, gables and ceiling of the booth of FIG. 1 and more uniformly about a vehicle therein.

Thus, whether a plurality of the filter cloth strips 140 or a plurality of filter cloth strips 192 are used, air can flow from substantially all of the ceiling, gable and side walls to surround the article being painted or on which the paint is being baked or dried. Referring to FIG. 15, this air flow surrounding the vehicle is schematically illustrated. As is apparent from this FIGURE, the air which the painter breathes is essentially free of evaporating paint vapors. Likewise, when the booth is used as an oven with the continuous supply of air from the side walls, gables and ceiling, the vehicle has a more uniform temperature rise than if the heated air were merely provided from the ceiling or the ceiling and only a portion of the sidewalls. Consequently, paint drying and vaporization of solvents from the vehicle is more uniform. This help avoid defects in the paint due to the solvent on a part of the vehicle (usually closest to the ceiling in a prior art booth), evaporating too quickly, sometimes called "solvent pop" in the automobile painting trade.

While the preferred embodiment of the present invention has been disclosed and described, it should be understood that modifications and equivalent structures and elements fall within the scope of the appended claims.

What is claimed is:

1. A painting structure for use in painting an article, comprising a pair of spaced apart outer walls, a roof supported by said outer walls, a floor, said roof and floor joining said outer walls at the tops and bottoms, respectively, a plurality of inner filter wall panels spaced along the length of each of said outer walls, extending from said floor to just below said roof and spaced inwardly away from each of said outer walls to form a plurality of spaced wall plenums, each of said wall plenums having one of said inner filter wall panels for its inner side and said outer walls forming other sides of each of said wall plenums, a plurality of filter ceiling panels spaced along the length of and below said roof and extending to said inner filter wall panels at the tops thereof, said filter ceiling panels and roof forming a plurality of roof plenums, each of said roof plenums having a filter ceiling panel for its lower side and said roof forming other sides of each of said roof plenums, a work space located between said inner filter wall panels, above said floor and below said filter ceiling panels, at least a portion of each of said plurality of inner filter wall panels and each of said plurality of filter ceiling panels being formed of a replaceable air filter material, said plurality of inner filter wall panels and said plurality of filter ceiling panels being aligned with one another, said plurality of wall plenums and said plurality of roof plenums being connected together to form a plurality of inverted "U" shaped ducts spaced along the length of said structure, each of said plurality of "U" shaped ducts being connected to the adjacent "U" shaped ducts to form air distribution ducting for distributing air to said work space, whereby air supplied to any portion of said air distribution ducting is distributed to other portions of said air distribution ducting and flows through said filter ceiling panels and said inner filter wall panels into said work space.

2. A painting structure as in claim 1, wherein each of said inner filter wall panels and said filter ceiling panels further comprise movable filter frame means for carrying said air filter material, whereby said air filter material is easily changed by moving said movable frame means.

3. A painting structure as in claim 2, wherein said filter frame means for adjacent said inner filter wall panels and filter ceiling panels are joined together to form movable units.

4. A painting structure as in claim 3, wherein said air filter material comprises a plurality of strips, each of said strips extending across a portion of one of said filter ceiling panels and one of the adjacent said inner filter wall panels.

5. A painting structure as in claim 1, further comprising lighting panels interspaced between said plurality of inner filter wall panels.

6. A painting structure as in claim 1, wherein the upper corners of said inner filter wall panels and the outer ends of said filter ceiling panels join to each other to form gable plenum means extending the length of the structure for connecting said inverting "U" shaped ducts together.

7. A painting structure as in claim 1, wherein said floor further comprises a plurality of floor panels each adjustably positionable over the ground to provide a level floor.

8. A painting structure as in claim 7, further comprising lower support feet for said floor resting on the ground, said floor panels being adjustably positionable over said lower support feet.

9. A painting structure as in claim 8, further comprises inclined bar joists extending between said lower supports feet and said floor panels, said bar joists and one of said lower support feet and floor panels being adjustable relative one another, whereby a level floor is provided by adjusting said bar joists and one of said lower support feet and floor panels.

10. A painting structure as in claim 1, further comprising air treatment means for treating air for spray painting, said air treatment means supplying treated air to said air distribution ducting.

11. A painting structure as in claim 10, further comprising air heating means for heating air for paint drying, said air heating means supplying heated air to said air distribution ducting.

12. A painting structure as in claim 1, further comprising air heating means for heating air for paint drying, said air heating means supplying heated air to said air distribution ducting.

13. A painting structure as in claim 2, wherein said air filter material is removably secured to said filter frame means for said inner filter wall panel and said filter ceiling panel, and further comprising battens for supporting said air filter material on said filter frame means, said battens being spaced apart and secured to portions of said filter frame means.

14. A painting structure as in claim 13, wherein said battens are removably secured to said filter frame means and said air filter material has pockets therein to carry said battens, whereby said air filter material supports said battens and said battens support said air filter material.

15. In a filter material for a painting structure having a plurality of filter panels comprising movable filter frame means for carrying said filter material, said filter material comprising an elongated strip of air filter cloth, said elongated strip of air filter cloth having a plurality of pockets formed therein at spaced intervals and having at least one opening therein, and a plurality of removable battens loosely installed in said pockets through said openings, said plurality of pockets receiving and carrying said plurality of removable battens for supporting the filter materials on said filter frame means of said filter panels.

16. In a filter material as in claim 15, wherein said painting structure includes a plurality of filter wall panels in alignment with a plurality of filter ceiling panels, the length of said elongated strip of air filter cloth being sufficient to extend across at least one half of one of said filter ceiling panels and down one of said aligned filter wall panels.

17. A painting structure as in claim 1, wherein each of said outer walls is bent inwardly and extends between adjacent wall plenums, said outer wall forming three sides of each of said wall plenums and strengthening said outer wall.

18. A painting structure as in claim 17, wherein said roof is bent downwardly and extends between adjacent ceiling plenums, said roof forming three sides of each of said ceiling plenums and strengthening said roof.

19. A painting structure as in claim 1, wherein said roof is bent downwardly and extends between adjacent ceiling plenums, said roof forming three sides of each of said ceiling plenums and strengthening said roof.

* * * * *